US006111489A

United States Patent [19]

Tiemann

[11] Patent Number: 6,111,489

[45] Date of Patent: Aug. 29, 2000

[54] CIRCUIT BREAKER CONFIGURATION

[75] Inventor: Jerome Johnson Tiemann, Schenectady, N.Y.

[73] Assignee: General Electric Company, Schenectady, N.Y.

[21] Appl. No.: 09/240,019

[22] Filed: Jan. 29, 1999

[51] Int. Cl.[7] ..... H01H 9/02

[52] U.S. Cl. ..... 335/202; 335/8

[58] Field of Search ..... 335/8–10, 18, 335/132, 202; 361/42–49

[56] References Cited

U.S. PATENT DOCUMENTS

| | | | |
|---|---|---|---|
| 4,641,216 | 2/1987 | Morris et al. | 361/42 |
| 5,136,454 | 8/1992 | Halferty et al. | 361/42 |
| 5,260,676 | 11/1993 | Patel et al. | 335/18 |
| 5,446,431 | 8/1995 | Leach et al. | 335/18 |
| 5,481,235 | 1/1996 | Heise et al. | 335/18 |
| 5,686,709 | 11/1997 | Casagrande et al. | 200/50.32 |

*Primary Examiner*—Lincoln Donovan
*Attorney, Agent, or Firm*—Jill M. Breedlove; Douglas E. Stoner

[57] ABSTRACT

A breaker, wherein the circuits for the power lines and the neutral line extend through one current transformer. The breaker has a reduced width as compared to known two pole breakers so that additional breakers can be included on one panel. More specifically, the component configuration of the breaker provides a simplified arrangement of the power line circuits so that such circuits readily extend through one current transformer. In addition, the architecture provides that the width of the breaker can be reduced to about 0.5 inches per pole, which enables securing additional breakers to one panel.

19 Claims, 2 Drawing Sheets

CIRCUIT BREAKER CONFIGURATION

BACKGROUND OF THE INVENTION

This invention relates generally to circuit breakers and more particularly, to a wiring configuration which facilitates detecting fault current for tripping a breaker.

A typical circuit breaker includes current sensors for identifying transients in the power line current and controls for determining when to trip, i.e., open, a particular branch of the system. For example, the power line carries an input current, $I_{in}$. A current sensor senses the input current $I_{in}$ and provides a scaled output current, $I_{out}$, having a magnitude proportional to the input current, $I_{in}$, but many magnitudes lower than input current, $I_{in}$. The scaled output current, $I_{out}$, is used to identify transients and to determine when to trip the system.

A known current sensor includes a current transformer having a core of magnetic material and one or two secondary windings. Each winding has a large number of turns of fine gauge wire evenly distributed around the core. The core encircles the power line carrying input current, $I_{in}$.

In operation, an alternating magnetic flux from the power line carrying current, $I_{in}$ is induced in the current sensor core. A voltage therefore is induced in the secondary winding of the sensor. The signal from one secondary winding is provided to, for example, a high gain differential amplifier. The output of this amplifier can serve as a measure of the current, or for improved accuracy, the amplifier output can be supplied to a feedback winding to measure the zero-flux condition in the core. In this case, the current in the feedback winding is scaled output current, $I_{out}$.

Known one pole breakers with ground-fault interruption capability contain a current transformer with two conductors passing through the transformer core, and known two pole breakers with ground-fault interruption capability contain a current transformer with three conductors passing through the transformer core. Specifically, in two pole breakers, the two power lines and the common neutral extend through the core. The power lines and neutral are arranged so that current flows through the lines in opposite directions. Such opposing current flow results in a net transformer output of zero under normal steady state operation. Any departure from cancellation of the magnetic field created by the current flows in opposing directions indicates that some current escaped to ground. If the escaped current exceeds a set point, the breaker should open. Since a perfect balance between all three currents does not imply a balance between any two, it is not possible to detect a small unbalance unless all three conductors pass through the transformer.

With such known two pole breakers, the first power line (L1) and the neutral line (N) are secured to a first subassembly, and the second power line (L2) is secured to a second subassembly. The first and second subassemblies are then connected with a plurality of optically isolated signal wires and engaged (e.g., riveted) to form the breaker. Arranging the power lines and the neutral line so that all lines extend through one current transformer creates assembly problems, and also creates sensing problems, due to the possibility that one pole line may be disconnected while the other line has a fault. It would be desirable to provide a two pole breaker configuration that is easy to assemble yet uses a current transformer to detect fault current in all the lines and whose circuitry can be powered by either pole.

Also, at least one known one pole breaker is about ¾ inch wide and a known two pole breaker requires twice that width on the breaker panel. The width of the breaker limits the number of breakers that can be secured to one panel. It would be desirable to provide a two pole breaker that has a width of 1 inch so that more breakers can be secured to one breaker panel. As such, it would be desirable that the two pole fault detecting breaker utilize tested components already in use in ½ inch wide one pole breakers.

Furthermore, it would be desirable to provide a one pole fault detecting breaker that is only ½ inch wide.

BRIEF SUMMARY OF THE INVENTION

These and other objects may be attained by a two pole breaker that includes two one-pole modules, with each module powered by the power line, or pole, it is connected to, and wherein the conductors for the power lines and the neutral line extend through the current transformers of the respective modules. More specifically, the component configuration, or architecture, of the breaker provides a simplified arrangement of the power line and neutral conductors so that such conductors readily extend through the current transformer on each of the circuit boards. In addition, the architecture provides that the width of the breaker can be reduced to about 0.5 inches per pole, which enables securing additional breakers to one panel.

In one embodiment, the breaker includes two current transformers, a trip mechanism, which can be coupled together to form a single two-pole trip mechanism, and two subassemblies. Each subassembly includes a printed circuit board coupled to respective outputs from a bimetallic current sensing resistor and one current transformer for processing trip signals. In addition, the first subassembly includes a conductive plate having a terminal for connecting to the breaker panel port for line L2. The conductive plate also includes an output terminal configured to be secured to one end of a flexible cable. The first subassembly further includes line connectors, or terminals, for connecting to line L1 and neutral N. The breaker panel port terminal is at a first end of the first subassembly, and the line and neutral terminals are at an opposing end. The current transformer for this subassembly is at an intermediate location between the breaker panel port terminal and the line terminals.

A second subassembly includes a conductive plate having a terminal for connecting to the breaker panel port for line L1. The conductive plate also includes an output terminal configured to be secured to one end of a flexible cable. The second subassembly further includes a line connector, or terminal, for connecting to line L2, and a pigtail terminal for connecting to the ground bus. As with the first subassembly, the breaker panel port terminal is at a first end of the first subassembly, and the line terminal is at an opposing end. The current transformer for the second subassembly is at an intermediate location between the breaker panel port terminal and the line terminal. With the exception that there are three conductors within the openings of the current transformers instead of two, each of these subassemblies is essentially a fully functional one pole breaker. The first and second subassemblies are configured to be coupled together to form the two pole breaker.

BRIEF DESCRIPTION OF THE DRAWINGS

The foregoing and other objects, aspects and advantages will be better understood from the following detailed description of a preferred embodiment of the invention with reference to the drawings, in which.

DETAILED DESCRIPTION OF THE INVENTION

The present invention is generally directed to providing a breaker configuration wherein the power lines and the neutral line extend through the same current transformer. The circuit breaker components described herein are well known. The component configuration, or architecture, however, overcomes shortcomings of the known art in that the architecture provides simplified arrangements of the power lines so that such lines readily extend through the breaker current transformers. The architecture also provides interruption of both poles when either pole develops a fault while the other pole is disconnected. In addition, the architecture provides that the width of the breaker can be reduced to about 0.5 inches per pole as compared to a known breaker, which enables securing additional breakers to one panel.

Figure 1:
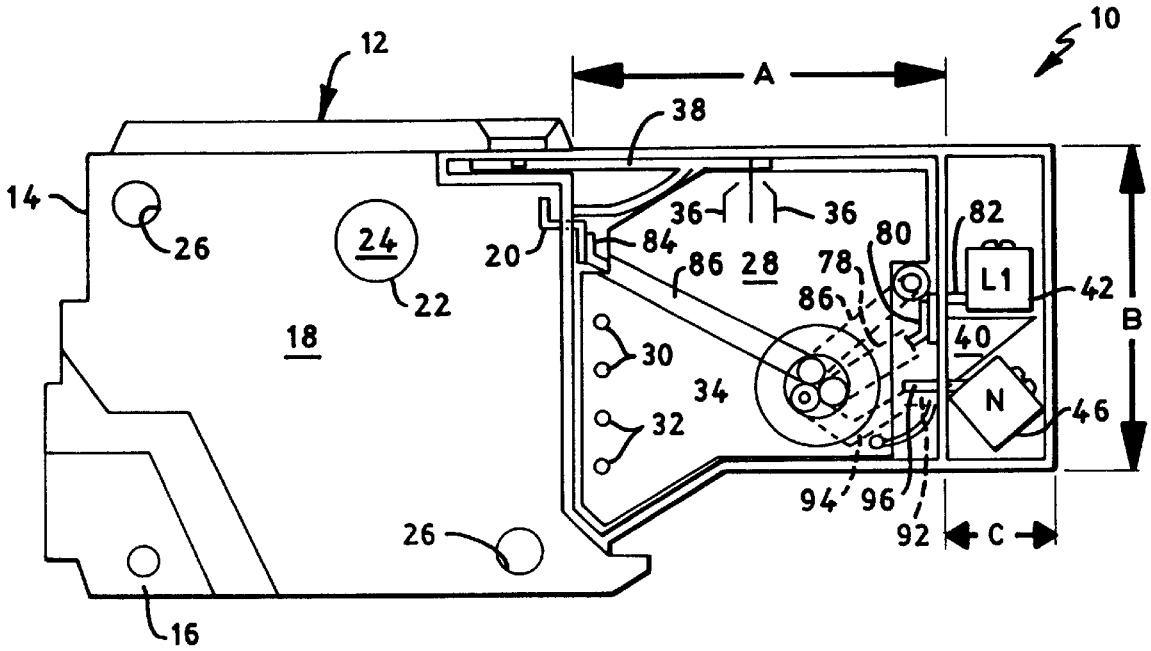
FIG. 1 is a plan view of a first portion of a two pole breaker.
Figure 2:
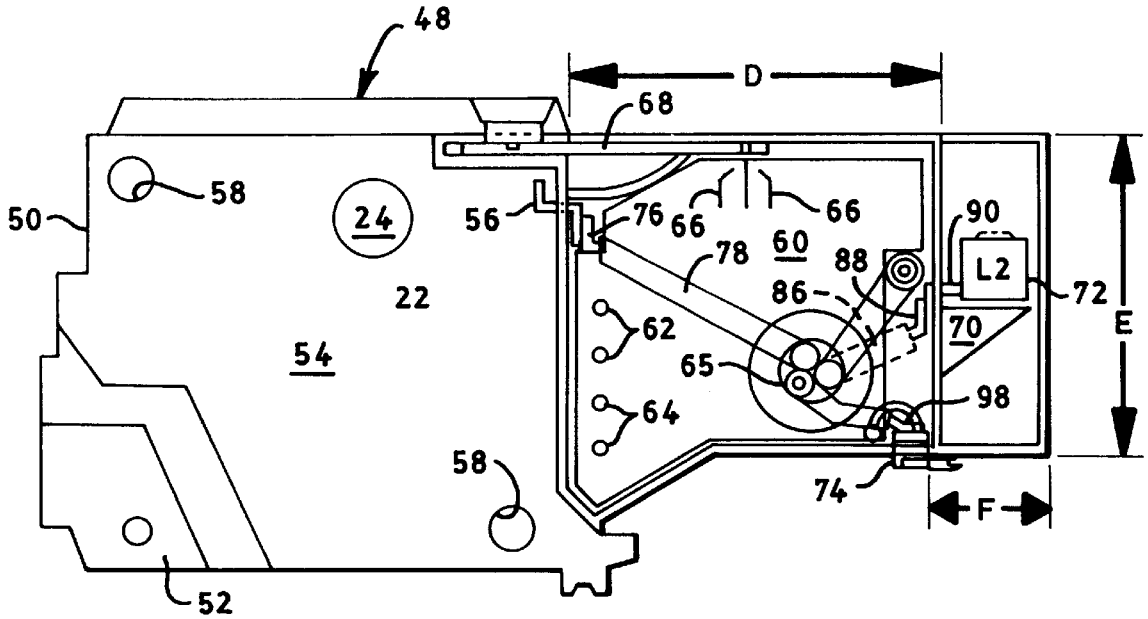
FIG. 2 is a plan view of a second portion of a two pole breaker.

Referring now particularly to the drawings, FIG. 1 is a plan view of a breaker 10, and more particularly, a first breaker subassembly 12. Subassembly 12 includes a housing 14 and a terminal 16 for being directly connected to a power line L2 (FIG. 2). Terminal 16 is configured to be directly coupled to a breaker panel port (not shown), which in turn is connected to power line L2. Terminal 16 is an opening in a conductive plate 18 (e.g., copper), and a power output terminal 20 is welded thereto. Also, a breaker mechanism 22 extends through plate 18, and mechanism 22 includes a mechanical bar 24. Rivet openings 26 in plate 18 facilitate securing subassembly 12 to the other subassembly which is described below in more detail.

Breaker subassembly 12 also includes a printed wiring board 28 having terminals 30 for receiving a bimetal current sensing element, and terminals 32 for activating a trip solenoid. A magnetic ring 34 having a coil wrapped therearound to form a toroidal winding, i.e., a transformer, is secured to board 28 which has an opening that matches the opening in transformer 34. In addition, contacts 36 for a slide tester 38 are secured to board 28.

Breaker subassembly 12 further includes a first line mount 40 and a line (L1) terminal 42 secured to mount 40. Terminal 42 is configured to be electrically connected to a distribution line (L1) of a power delivery network. A neutral (N) terminal 46 also is secured to mount 40. With respect to the dimensions of subassembly 12, distance "A" is about 1.92 inches, distance "B" is about 1.6 inches, and distance "C" is about 0.57 inches.

FIG. 2 is a plan view of a second breaker subassembly 48 of breaker 10. Subassembly 48 includes a housing 50 and a terminal 52 for being directly connected to power line L1 (FIG. 1). Terminal 52 is configured to be directly coupled to a breaker panel port (not shown), which in turn is connected to power line L1. Terminal 52 is an opening in a conductive plate 54 (e.g., copper), and a power output terminal 56 is welded thereto. The conductors indicated by the cross and the dot extend upward through the transformer opening in a direction perpendicular to the page while the conductor marked with the plus sign extends upward from a position at the side of board 60. Breaker mechanism 22 extends through plate 54. Rivet openings 58 in plate 54 facilitate securing subassembly 48 to subassembly 12 (FIG. 1), i.e., openings 58 align with openings 26 (FIG. 1).

Subassembly 48 includes printed wiring board 60 having terminals 62 for receiving a bimetal element, and terminals 64 for receiving a trip solenoid. A magnetic ring 65 having a coil would therearound extends through board 60. Contacts 66 for a slide tester 68 also are secured to board 60. Subassembly 48 further includes a second line mount 70 and a line (L2) terminal 72 secured to mount 70. Terminal 72 is configured to be electrically connected to distribution line (L2) of a power delivery network. A pigtail type connector 74 is secured to board 60 and is configured to be electrically coupled to the common ground terminal of the breaker panel. With respect to the dimensions of subassembly 48, distance "D" is about 1.92 inches, distance "E" is about 1.6 inches, and distance "F" is about 0.57 inches.

Again, the components of subassemblies 12 and 48 are well known. Also, it should be recognized that plates 18 and 54 are located in a first compartment, current transformer 34 is located in a second compartment, and terminals L1, L2, and N are in a third compartment. Such compartmentalization facilitates isolation of the components.

To assemble breaker 10, first subassembly 12 and second assembly 48 are aligned, and the upward extending conductors are fed through the corresponding opening of second subassembly 48. The circuits through breaker 10 are then established. More specifically, the circuit for line L1 extends from terminal 52 (FIG. 2) which couples directly to the breaker panel port, across conductive plate 54, and to power output terminal 56. One end 76 of a flexible conductive cable 78 is welded to terminal 56, and cable 78 extends through transformers 34 and 65. The other end 80 of cable 78 is welded to a conductive arm 82 of line (L1) terminal 42 (FIG. 1).

The circuit for line L2 extends from terminal 16 (FIG. 1) which couples directly to the breaker panel port, across conductive plate 18, and to power output terminal 20. One end 84 of a flexible conductive cable 86 is welded to terminal 20, and cable 86 extends through transformers 34 and 65. The other end 88 of cable 86 is welded to a conductive arm 90 of line (L2) terminal 72 (FIG. 2).

For the neutral line N, one end 92 of a flexible conductive cable 94 is welded to a conductive arm 96 of neutral (N) terminal 46 (FIG. 1). Cable 94 extends through transformers 34 and 65 and the other end of cable 94 is welded to a conductive arm 98 of pigtail connector 74 (FIG. 2).

In breaker 10, the circuits for lines L1, L2, and N extend through both current transformers 34 and 65. During steady state operations, the fields generated due to current flowing through lines L1, L2, and N cancel out and there typically is no current output from either transformer. In the event of a sufficient imbalance as predetermined based on desired operation, the fields will not cancel out and an imbalance signal will be generated by at least one transformer. If the imbalance is substantially larger than a predefined set point, both transformers will generate an imbalance signal sufficient to cause a trip signal to be generated thereby opening both L1 and L2. The imbalance signal is processed to determine whether to trip breaker 10, i.e., to activate trip mechanism 22. If a trip signal is generated on either pole, then the power across both lines L1 and L2 is interrupted if mechanical bar 24 is installed, otherwise only the one pole where the overload occurred will trip.

Breaker 10 provides that the line circuits of a two pole system all extend through the same current transformer, i.e., the combination transformer formed by transformers 34 and 65, yet breaker 10 is easy to assemble. In addition, breaker 10 has a width of about 0.5" per pole and at least as compared to known two pole breaker that are about 1.5" wide, additional breakers 10 can be secured to one panel. More particularly, breaker 10 has a plurality of dimensions including a length and width. The width of breaker 10 is shorter than the breaker length. By reducing the width of breaker 10 as compared to the width of known breakers (although the length of breaker 10 may be longer than the length of known breakers) more breakers can be located on one board. The reduced width is provided, at least in part, because the axis of the current transformers in breaker 10 is parallel to the width. In known breakers, the current transformers are perpendicular to the width, which results in a shorter length but a wider width.

Figure 3:
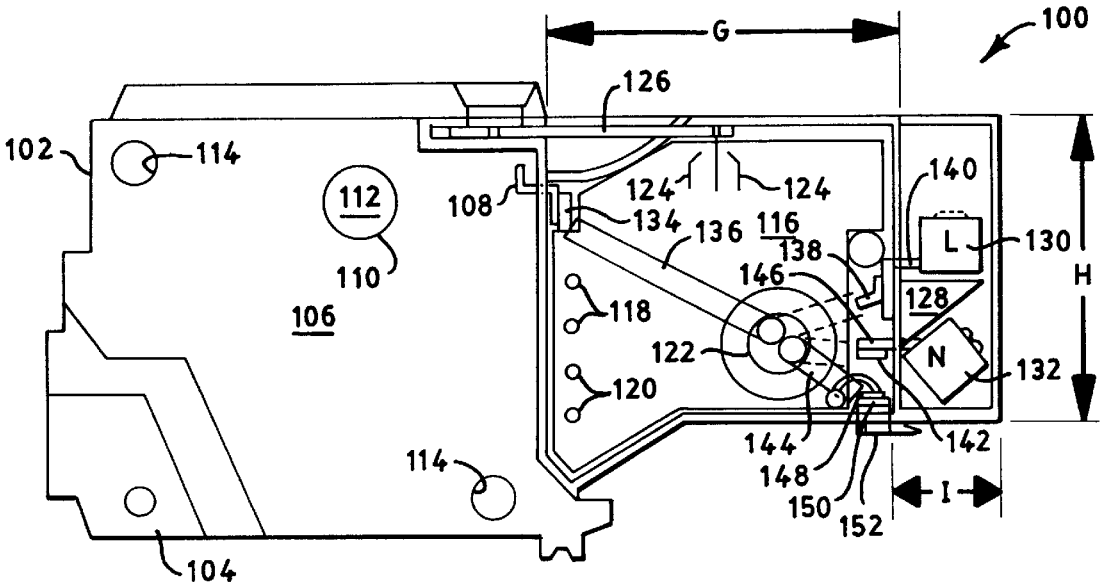
FIG. 3 is a plan view of a one pole breaker.

Also, in order to minimize the number of different parts, it is desirable to fabricate a two pole breaker from the same parts as are used in a one pole breaker. It is also desirable to use parts that have been tested and approved, and which are known to function correctly. By way of example, FIG. 3 is a plan view of a one pole breaker 100 made from the same breaker mechanism and the same circuit board as is used in each subassembly in breaker 10. Breaker 100 includes a housing 102 and a terminal 104 for being directly connected to a first power line L1. Terminal 104 is configured to be directly coupled to a breaker panel port (not shown), which in turn is connected to power line L2. Terminal 104 is an opening in a conductive plate 106 (e.g., copper), and a power output terminal 108 is welded thereto. Also, a breaker mechanism 110 extends through plate 106, and mechanism 110 includes a mechanical bar 112. Rivet openings 114 in plate 106 facilitate securing a cover (not shown) over plate 106.

Breaker 100 also includes a printed wiring board 116 having terminals 118 for receiving a bimetal element, and terminals 120 for receiving a trip solenoid. A magnetic ring 122 having a coil wrapped therearound to form a toroidal winding is secured to and extends through board 116. In addition, contacts 124 for a slide tester 126 are secured to board 116.

Breaker 100 further includes a line mount 128 and a line (L1) terminal 130 secured to mount 128. Terminal 130 is configured to be electrically connected to a distribution line (L1) of a power delivery network. A neutral (N) terminal 132 is secured to mount 128. With respect to the dimensions of breaker 100, distance "G" is about 1.92 inches, distance "H" is about 1.6 inches, and distance "I" is about 0.57 inches.

The circuit for line L1 extends from terminal 104 which couples directly to the breaker panel port, across a conductive plate 106, and to power output terminal 108. One end 134 of a flexible conductive cable 136 is welded to terminal 108, and cable 136 extends through transformer 122. The other end 138 of cable 136 is welded to a conductive arm 140 of line (L1) terminal 130.

For the neutral line N, one end 142 of a flexible conductive cable 144 is welded to a conductive arm 146 of neutral (N) terminal 132 (FIG. 1). Cable 144 extends through transformer 122 and the other end of cable 148 is welded to a conductive arm 150 of a pigtail connector 152.

In breaker 100, the circuits for lines L1 and N extend through one current transformer. During steady state operations, the fields generated due to current flowing through lines L1 and N cause a current to be induced in the windings of transformer 122. The signal output by transformer 122 during steady state operations can be determined. In the event of a deviation from expected transformer output, the transformer output signal is processed to determine whether to trip breaker 100, i.e., to activate trip mechanism 110. Breaker 100 provides many of the same advantages as breaker 10, including reduced width.

From the preceding description of various embodiments of the present invention, it is evident that the objects of the invention are attained. Although the invention has been described and illustrated in detail, it is to be clearly understood that the same is intended by way of illustration and example only and is not to be taken by way of limitation. Accordingly, the spirit and scope of the invention are to be limited only by the terms of the appended claims.

What is claimed is:

1. A circuit breaker for a power delivery system including at least one distribution line and a neutral line, said breaker having a plurality of dimensions including a length and width, at least one of said dimensions being shorter than said other dimensions, said breaker further comprising:

a first conductive plate comprising an input terminal and an output terminal;

a first current transformer having an axis parallel to said short dimension; and a first conductor extending from said first conductive plate output terminal through said current transformer.

2. A circuit breaker in accordance with claim 1 wherein said first conductive plate input terminal is configured to be connected to a breaker panel port.

3. A circuit breaker in accordance with claim 2 wherein said input terminal is at one side of said first conductive plate and said output terminal is at an opposing side of said first conductive plate.

4. A circuit breaker in accordance with claim 1 wherein said first current transformer comprises a magnetic ring having a coil wrapped therearound.

5. A circuit breaker in accordance with claim 1 further comprising a first line terminal unit configured to be electrically connected to the distribution line, said first conductor extending from said first conductive plate output terminal through said first current transformer to said first line terminal unit.

6. A circuit breaker in accordance with claim 5 wherein said first current transformer is at an intermediate location between said input terminal and said first line terminal unit.

7. A circuit breaker in accordance with claim 1 further comprising:

a second conductive plate comprising an input terminal and an output terminal;

a second line terminal unit to be electrically connected to the distribution line;

a second current transformer;

a first conductor extending from said first conductive plate output terminal, through said second current transformer, and to said second first line terminal unit; and a second conductor extending from said second conductive plate output terminal, through said second current transformer, and to said first line terminal unit.

8. A circuit breaker in accordance with claim 7 further comprising:

a neutral terminal unit to be electrically connected to the distribution line;

a connector; and a third conductor extending from said neutral terminal unit, through said second current transformer, and to said connector.

9. A circuit breaker in accordance with claim 7 wherein said second conductive plate input terminal is configured to be connected to a breaker panel port.

10. A two pole circuit breaker for a power delivery system including at least one distribution line and a neutral line, said breaker comprising:

a first subassembly comprising a first conductive plate comprising an input terminal and an output terminal;

a second subassembly comprising a second conductive plate comprising an input terminal and an output terminal, said second subassembly identical to said first subassembly;

a current transformer;

a first line terminal unit to be electrically connected to the distribution line;

a second line terminal unit to be electrically connected to the distribution line;

a first conductor extending from said first conductive plate output terminal, through said current transformer, and to said second line terminal unit; and a second conductor extending from said second conductive plate output terminal, through said current transformer, and to said first line terminal unit.

11. A two pole circuit breaker in accordance with claim 10 further comprising:

a neutral terminal unit to be electrically connected to the distribution line;

a connector; and a third conductor extending from said neutral terminal unit, through said current transformer, and to said connector.

12. A two pole circuit breaker in accordance with claim 10 wherein said first and second conductive plate input terminals are configured to be connected to respective breaker panel ports.

13. A two pole circuit breaker in accordance with claim 10 wherein said current transformer comprises a magnetic ring having a coil wrapped therearound.

14. A two pole circuit breaker in accordance with claim 10 wherein said current transformer comprises a first current transformer and a second current transformer.

15. A method for fabricating a circuit breaker for a power delivery system including at least one distribution line and a neutral line, the breaker including a first conductive plate comprising an input terminal and an output terminal, a current transformer, said method comprising the step of extending a first conductor from the first conductive plate output terminal through the current transformer.

16. A method in accordance with claim 15 wherein the circuit breaker further includes a second conductive plate comprising an input terminal and an output terminal, said method further comprising the step of extending a second conductor from the second conductive plate output terminal through the current transformer.

17. A method in accordance with claim 15 wherein the circuit breaker further includes a neutral terminal unit electrically connected to the distribution line, and said method further comprising the step of extending a third conductor from the neutral terminal unit through the current transformer.

18. A circuit breaker in accordance with claim 1, wherein the width dimension is about one-half inch.

19. A circuit breaker in accordance with claim 10, wherein the width dimension is about one-half inch per pole.

* * * * *